US005251598A

United States Patent [19]

Wietelmann

[11] Patent Number: 5,251,598

[45] Date of Patent: Oct. 12, 1993

[54] SYSTEM FOR REGULATING THE IDLING SPEED OF AN INTERNAL-COMBUSTION ENGINE

[75] Inventor: Juergen Wietelmann, Ditzingen, Fed. Rep. of Germany

[73] Assignee: Robert Bosch GmbH, Stuttgart, Fed. Rep. of Germany

[21] Appl. No.: 853,942

[22] Filed: Mar. 19, 1992

[30] Foreign Application Priority Data

Apr. 19, 1991 [DE] Fed. Rep. of Germany ..... 4112848

[51] Int. Cl.[5] ..... F02D 41/16

[52] U.S. Cl. ..... 123/339

[58] Field of Search ..... 123/339

[56] References Cited

U.S. PATENT DOCUMENTS 4,428,341 1/1984 Hassler et al. ..... 123/339

4,441,471 4/1984 Kratt et al. ..... 123/339

4,513,712 4/1985 Gassler et al. ..... 123/339

*Primary Examiner*—Andrew M. Dolinar

*Attorney, Agent, or Firm*—Kenyon & Kenyon

[57] ABSTRACT

A system for regulating the idling speed of an internal combustion engine, in particular a self-ignitable internal-combustion engine, includes a controller that has at least one integral component and one differential component. The response characteristic of the controller is able to be influenced dependent upon at least one operating parameter of the internal-combustion engine. The integral component is able to be influenced dependent upon an output variable of the differential component. Correction values, which define the response characteristic of the differential component, are dependent upon at least the rotational speed and the gas-pedal position.

17 Claims, 4 Drawing Sheets

SYSTEM FOR REGULATING THE IDLING SPEED OF AN INTERNAL-COMBUSTION ENGINE

FIELD OF THE INVENTION

The present invention relates to a system for regulating the idling speed of an internal-combustion engine, and in particular to a control system including a differential component and an integral component.

BACKGROUND INFORMATION

A system for regulating the idling speed of an internal-combustion engine is described in German Published Patent Application No. 33 29 800 (corresponding to U.S. Pat. No. 4,554,899). A system for the closed-loop control of the idling speed of an internal combustion engine, in particular a self-ignitable internal-combustion engine, by means of an adaptive controller is described therein. This controller contains a proportional, an integral, and a differential component. The response characteristic of the controller is able to be adjusted dependent upon the rotational speed. The dynamic performance of this device is not optimal. Thus, in certain operating states, the rotational speed may drop below the nominal idling speed. This is referred to as undercutting and should be prevented. Furthermore, various operating states exist with different controller action. Unsteadiness can occur when the transition is made from one operating state to another operating state with another controller action.

An object of the present invention is to improve the dynamic performance of a system for regulating the idling speed of an internal-combustion engine.

SUMMARY OF THE INVENTION

The present invention provides a control system for regulating the idling speed of an internal-combustion engine, and in particular a self-ignitable internal-combustion engine. The system includes a differential component and an integral component. The differential component receives at least one correction value based upon the rotational speed of the engine and the gas-pedal position. The differential component generates a first output signal based upon the correction value. This output signal is received by the integral component, which in turn generates a second output signal for controlling the idling speed of the engine.

With the system according to the present invention, the idling speed is, at most, only slightly undershot. Moreover, the control process is distinguished by a high quality control.

DETAILED DESCRIPTION

Figure 1:
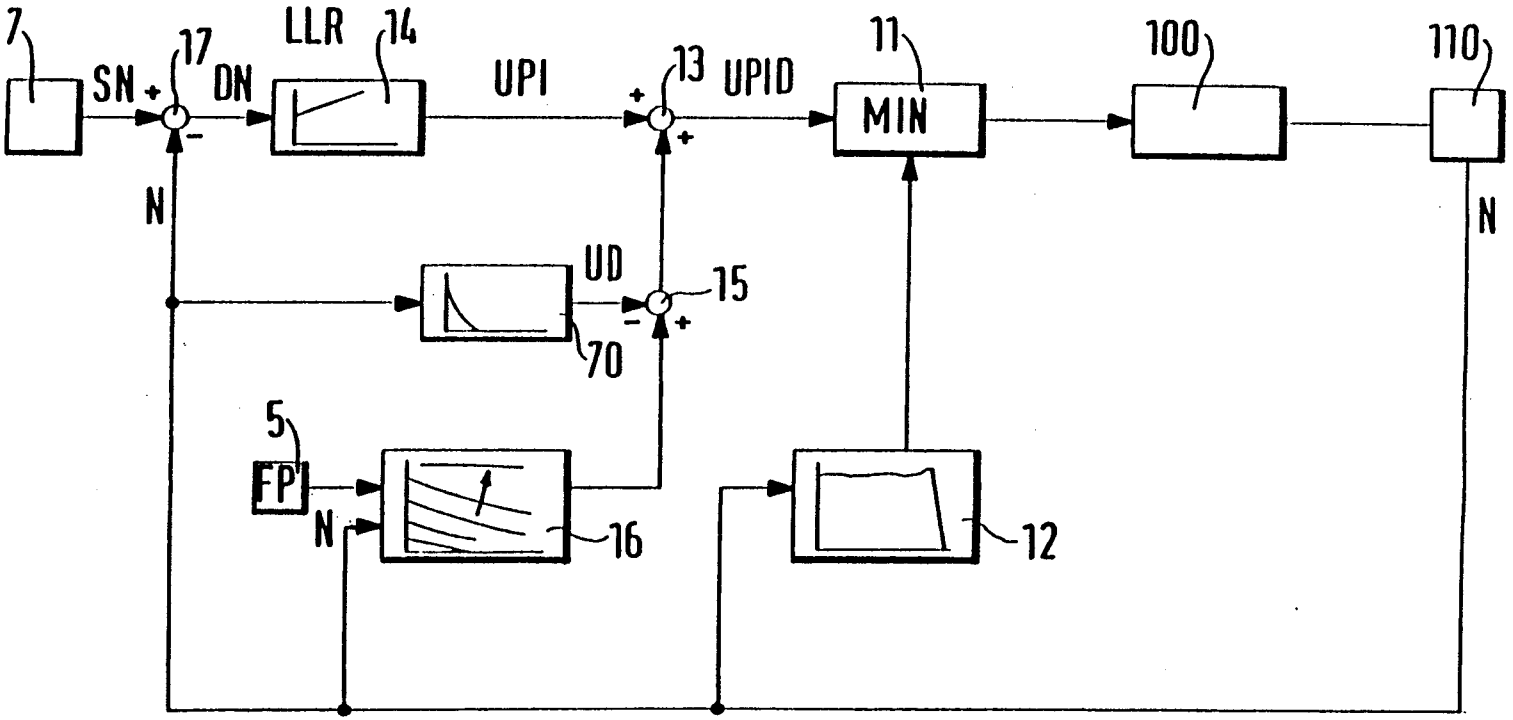
FIG. 1 shows a block diagram of a system according to the present invention.

FIG. 1 shows a block diagram of a system according to the present invention. An idle-speed controller 14 emits an output signal UPI to a controlling unit 100 via a summing point 13 and a minimum selection 11. Dependent upon its input signal, the controlling unit delivers the appropriate quantity of fuel into the combustion chambers of an internal-combustion engine (not shown). A speed sensor 110 detects the actual rotational speed N of the internal-combustion engine.

This rotational-speed signal N is fed to a limiting characteristics map 12, a driving-performance characteristics map 16, a reference point 17, as well as a differential component 70. The output signal of a setpoint selection 7 is applied to another input of the reference point 17. This setpoint selection 7 stipulates a setpoint value SN for the idling speed. The output signal DN of the reference point 17 is fed to the idle-speed controller 14.

The differential component 70 generates an output signal UD, which arrives with a negative sign at a summing point 15. The output signal from the driving-performance characteristics map 16 is applied to the second input of the summing point 15. The rotational-speed signal N, as well as the output signal from a gas-pedal position sensor 5, is applied to the inputs of the driving-performance characteristics map 16.

The output signal from the summing point 15 is fed to the summing point 13. The output signal from the summing point 13 UPID is compared in a minimum selection 11 to the output signal from the limiting characteristics map 12. The smaller of the signals serves to trigger the controlling unit 100.

The system shown in FIG. 1 functions as follows. Dependent upon the difference DN between the output signal SN of the setpoint selection 7 and the actual rotational speed N, the idle-speed controller calculates a limited actuating signal for the controlling unit 100. From this actuating signal in the summing point 13 is subtracted the output signal from the differential component, at the input of which is the actual rotational speed. If the gas pedal 5 is not actuated, this signal is the dominant factor in determining the quantity of fuel to be injected.

When the gas pedal is actuated, the driving-performance characteristics map 16 generates an output signal based upon the actual rotational speed and the gas-pedal position. This output signal is added to the output signal from the idle-speed controller. This actuating signal is limited in the minimum selection 11 to a highest permissible value, which depends at least on the actual rotational speed.

Figure 2:
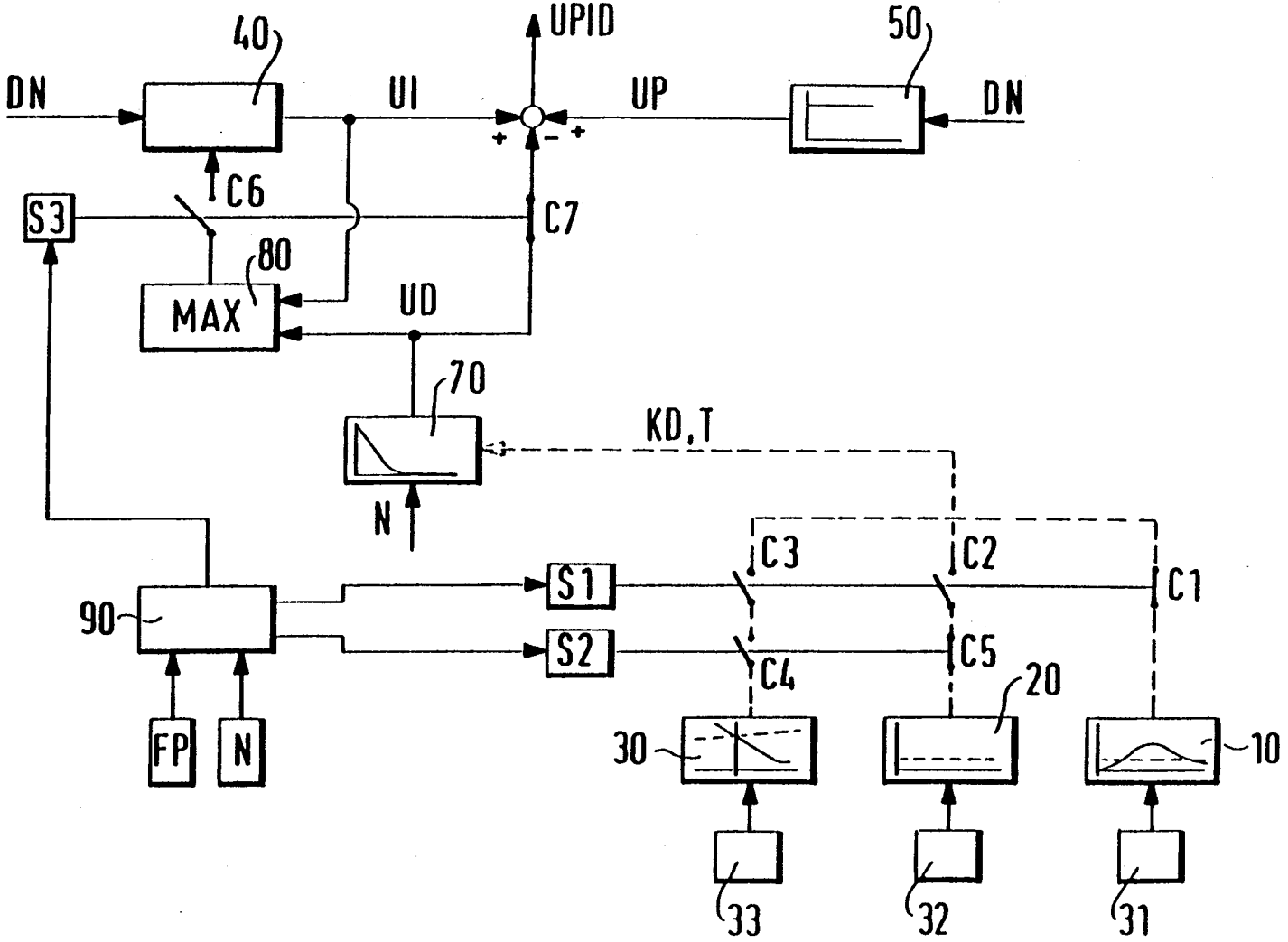
FIG. 2 shows a detailed block diagram of a portion of the system of FIG. 1.

FIG. 2 shows in detail how the idle-speed controller 14 and the differential component 70 interact. Starting from the system deviation DN, that is, the output signal of the reference point 17, the integral component 40 of the idle-speed controller 14 generates an output signal UI, which is limited.

Furthermore, starting from the system deviation DN, the proportional component 50 supplies an output signal UP. Based upon the actual rotational speed N, the differential component 70 generates an output signal UD. These three signals are added to form the quantity UPID in a summing point.

In addition, the output signal from the differential component 70 and the output signal from the limited integral component 40 are fed to a maximum selection 80. Its output signal applies a signal to the integral component 40 via a contact C6.

A dotted line indicates that, starting from the value tables 10, 20 and 30, the correction values KD and T of the differential component 70 can be adjusted. For this purpose, connected to the differential component 70 are the value table 10 via a contact C1, the value table 20 via the contacts C2 and C5, and the value table 30 via the contacts C3 and C4.

The correction values KD and T stored in the value tables 10, 20 and 30 depend upon the cooling water temperature TW and/or upon the fuel temperature TK. The value tables are connected to sensors 31, 32 and 33, which detect the cooling water temperature TW and/or the fuel temperature TK. The cooling water temperature corresponds to the engine temperature, and therefore, it can also be detected by an engine-temperature sensor.

The contacts C6 and C7 are actuated by a switch S3, the contacts C3, C2 and C1 by a switch S1, and the contacts C4 and C5 by a switch S2. A control unit 90 triggers the switches S1, S2 and S3. The triggering takes place based upon at least the gas-pedal position and the actual rotational speed.

Starting from the system deviation DN, the output signal UP from the proportional component 50 is calculated according to the formula:

$$UP = KP * DN$$

where KP is the correction value of the proportional component 50. The output signal UI from the integral component is calculated according to the formula:

$$UI = UIO + KI \int_{o}^{t} DN(T)\, DT$$

where KI is the correction value of the integral component. UIO represents the initial value of the integration. Thus, at the beginning of the integration, the output signal UI from the integral component corresponds to the initial value UIO.

Normally, the integration starts with the initial value UIO=0. This value corresponds to the lower limiting value $UI_{min}$. If, however, switch S3 is actuated and the contact C6 closes, the initial value UIO is set to the output signal of the maximum selection 80. The maximum selection 80 selects the larger of the two variables, which are the actuating signal UD of the differential component 70 and the actuating signal UI of the integral component 40. Consequently, the integral component 40 starts after the switch S3 is actuated with its last value or with the actuating signal UD output by the differential component 70. The integral component 40 emits an output signal, which lies within a range between a lower limiting value $UI_{min}$ and an upper limiting value $UI_{max}$. The lower limiting value $UI_{min}$ lies preferably at zero.

The correction values KD, T of the differential component 70 stored in six different value tables depend upon a temperature value. The water temperature TW and/or the fuel temperature TK serve as parameters for the value table. If a parameter value lies between two restart points, it is preferable for the value of the function to be interpolated linearly. In each case, one value table for the correction value KD and one value table for the correction value T belong together and represent one operating mode. Preferably, three different operating modes are possible, which are designated as closed-loop control 10, initialization 20, and precontrol 30. It is entirely conceivable, however, for other operating modes to be defined as well.

The system according to the present invention functions as follows. If the engine speed N is less than or equal to the constant nominal idling speed NS, then the contacts C1 through C7 are situated in the positions shown in FIG. 2. The result is that the value table 10 is connected to the differential component. Consequently, the closed-loop control operating mode is active and the idle-speed controller has the structure of an ordinary PID-action controller.

The time correction value T, which characterizes the drop in the output signal UD as a function of time, is constant over the entire value range. The KD correction value, which characterizes the amplification of the differential component, is at a maximum at a certain temperature value, and falls off at higher and lower values.

This operating mode is canceled when the driver operates the gas pedal and the engine speed increases due to the rise in the injection quantity from the driving-performance characteristics map 16. This process is usually described as an acceleration process. Thus, if the actual gas-pedal position lies over a specified threshold S and the rotational speed is greater than a first rotational-speed threshold N1, then the switch S1 is actuated. The first rotational-speed threshold N1 usually lies above the nominal idling speed NS.

Actuating the switch S1 causes the contacts C2 and C3 to close and the contact C1 to open. As a result of this switch actuation, the value table 20 becomes connected to the differential component 70. Thus, the initialization operating mode is achieved. The switch S1 is also actuated when the engine speed exceeds the threshold N2 because of a decrease in the load. Thus, it is no longer necessary to operate the gas pedal.

The parameters of the differential component 70 are selected so that the differential component does not hinder the internal-combustion engine's acceleration operation. This means that the correction value KD is selected as zero. Consequently, the manipulated variable UD assumes the zero value. Therefore, the differential component 70 no longer has an effect on the fuel quantity to be injected. Due to the increase in the rotational speed, the system deviation of the idle-speed controller automatically becomes negative. As a result, the integral component 40 of the idle-speed controller integrates toward its lower limit $UI_{min}$, which in this case is zero. Thus, the integral component 40 does not contribute to the manipulated variable UPID.

If it is ensured in this operating mode that the available proportional component also does not supply an output signal UP, the control loop is interrupted in this operating mode and, consequently, only an open-loop control of the rotational speed takes place. This means that only the driving-performance characteristics map 16 determines the fuel quantity to be injected.

If the gas-pedal actuation is withdrawn, this means that the actual position of the gas pedal is smaller than the threshold S, and the engine speed is lower than a second rotational-speed threshold N2, so that an actuation of the switch S2 follows. The second rotational-speed threshold N2 is usually greater than the first rotational-speed threshold N1.

As a result of the actuation of the switch S2, the contact C4 closes and the contact C5 opens. Therefore, the value table 30, and thus the precontrol operating mode become active. In this operating mode, the two correction values KD and T have a considerably greater value than in the other two operating modes. In this operating mode, the differential component determines the fuel quantity to be injected. The correction value KD thereby declines with rising temperature. On the other hand, the time correction value T increases slightly with rising temperature.

This operating mode is retained until the rotational speed reaches the nominal idling speed NS. If this is the case, the contact C6 is closed and the contact C7 is opened by means of the switch S3. The maximum selection 80 subsequently selects the greater value of the output signal UD of the differential component and the actual manipulated variable UI of the integral component. This value is then assumed as an initial value UIO in the integral component. The initial state is then reestablished by actuating the switches S1, S2 and S3.

In case of suddenly falling gas, the differential component assures that the engine is deliberately decelerated before reaching the idling speed. Suddenly falling gas refers to the state in which the gas-pedal position is less than a specific threshold and the rotational speed drops considerably. The braking takes place within a rotational-speed range which lies between the nominal idling speed NS and the second rotational-speed threshold N2. Thus, to enable a harmonious transition from an open-loop control of the idling speed to a closed-loop control of the idling speed, the established manipulated variable UD of the differential component 70 is compared to the manipulated variable UI of the integral component 40, and the maximum of these two values is accepted as the initial value UIO for the integral component 40. The closed-loop control operating mode is then activated.

Thus with the system according to the present invention, the differential component 70 of the idle-speed controller is parameterized so that in case of an operation with suddenly falling gas, the diesel engine is deliberately decelerated before reaching the actual idling speed, and the established manipulated variable of the differential component is accepted as the initial value for the integral component of the idle-speed controller. As a result of this procedure, the real rotational speed does not fall below the idling speed or falls only slightly below it, and the closed-loop control system possesses a high quality control.

Figure 3A:
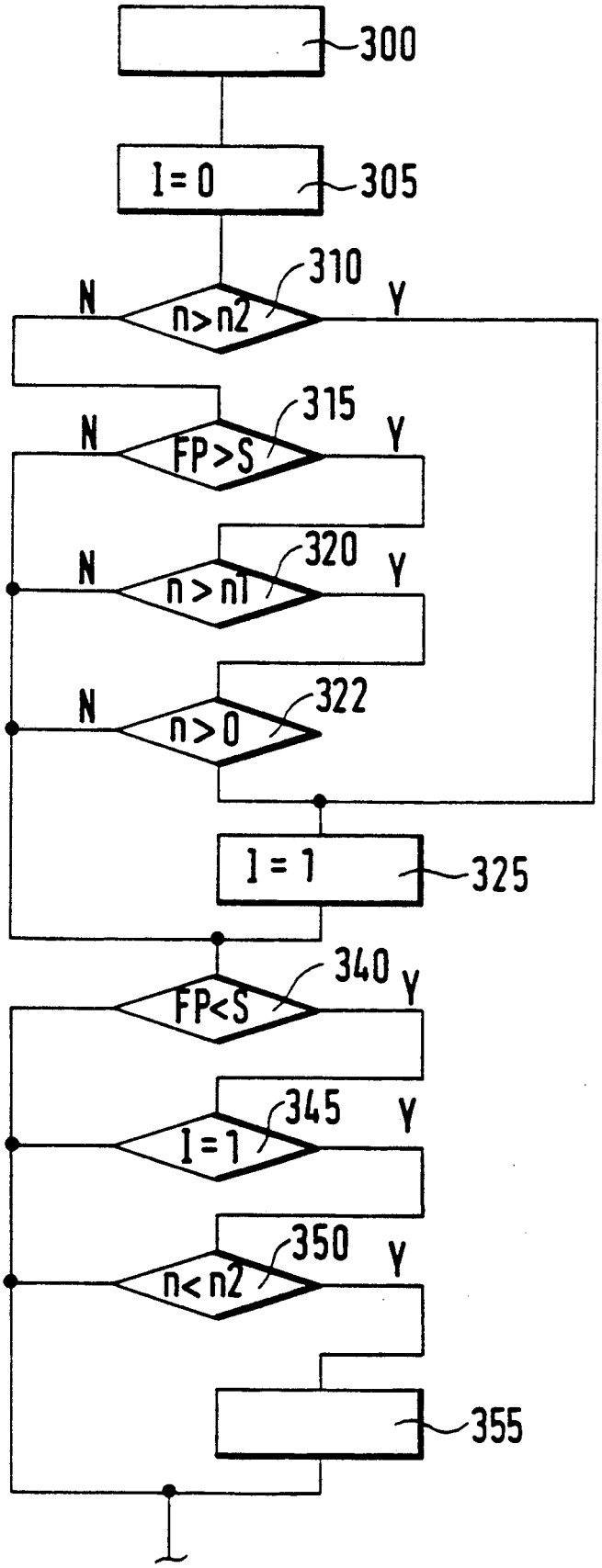
FIGS. 3*a* and 3*b* show a flow chart for the operation of the system according to the present invention.
Figure 3B:
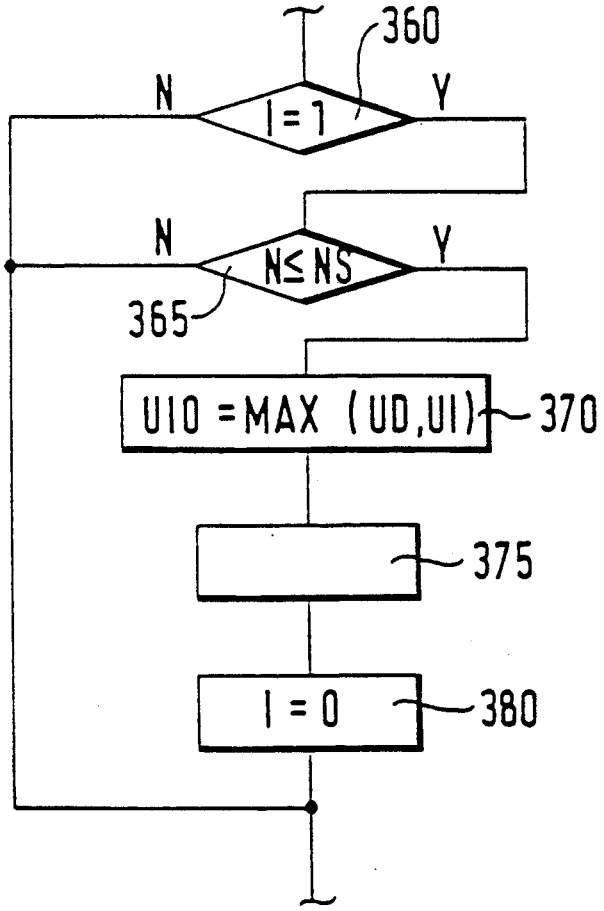

The operation of the system according to the present invention shall be clarified with reference to the flow chart shown in FIGS. 3*a* and 3*b*. Referring to FIG. 3*a*, the idling speed is controlled after it is recognized in step 300 that the internal-combustion engine has been started. A so-called noting bit I=0 is set in step 305. For so long as this noting bit is set to zero, the closed-loop control operating mode is active. This means that the differential component 70 is parameterized with the correction values stored in the value table 10. When applied to FIG. 2, this means that the switches S1, S2 and S3 are situated in the position shown in FIG. 2.

In step 310 it is recognized whether the rotational speed is greater than the second rotational-speed threshold N2. If the rotational speed N is less than the second rotational speed threshold N2, it is checked, in step 315, whether the gas-pedal position FP is greater than a threshold S. In step 320 it is checked whether the rotational speed exceeds the first rotational-speed threshold N1. In step 322 it is recognized whether the derivative of the rotational-speed signal is greater than zero.

If the conditions with respect to the gas-pedal threshold S, the first rotational-speed threshold N1, and with respect to the derivative of the rotational-speed signal are fulfilled, or if the rotational speed is greater than the second threshold N2, then the noting bit I is set to the value one, in step 325. When the noting bit has the value one, the initialization operating mode is active and the value table 20 determines the response characteristic of the differential component 70. When applied to FIG. 2, this means that the switch S1 is actuated. This causes the contacts C3 and C2 to close and the contact C1 to open.

In step 340 it is recognized whether the gas-pedal position is less than the threshold S. If, in step 345, it is recognized that at the same time the noting bit has the value one, and, in step 350, that the rotational speed is less than the second rotational-speed threshold N2, then the precontrol operating mode is activated in step 355. In this operating mode, the value table 30 is used. Applied to FIG. 2, this means that the switch S2 is actuated. The result is that the contact C4 closes and the contact C5 opens.

Step 360 then follows. As shown in FIG. 3*b*, in step 360 it is checked whether the noting bit has the value one. In step 365 it is recognized whether the rotational speed N falls below the nominal idling speed NS. If these conditions are satisfied, the initial value UIO for the integral component is calculated in step 370. To this end, the greater selection produces the greater value from the momentary output signal UD of the differential component and the momentary output signal UI of the integral component. The greater of these two signals is employed as an initial value UIO.

In step 375, the starting value UIO, starting from where the integral component integrates, is set to the beginning value calculated in step 370. The noting bit is subsequently reset to zero in step 380. Thus, the closed-loop control operating mode is again active. The procedure is then repeated from step 310.

Applied to FIG. 2, this means that the switch S3 is actuated in step 375. The result is that the contact c6 closes and the contact c7 opens. The integrator 40 thus assumes the initial value calculated in step 370. The switches S1, S2 and S3 are subsequently actuated so that they again assume the position shown in FIG. 2. Thus, the closed-loop control operating mode is again achieved.

The system according to the present invention is described above with reference to a self-ignitable internal-combustion engine as an example. However, the system can easily be used for other types of internal-combustion engines as well. The controlling unit 100 influences the power output of the internal-combustion engine. Thus, in the case of separate ignition, the position of the throttle valve depends on the position of the gas pedal. In this case, the controlling unit 100 influences the position of the throttle valve. The throttle-valve position takes the place of the quantity of fuel to be injected.

What is claimed is:

1. A control system for regulating the idling speed of an internal-combustion engine of a vehicle, comprising:

a differential component receiving at least one correction value based upon a rotational speed of the engine and upon at least one of a plurality of engine characteristics selected as a function of a position of a gas pedal of the vehicle, the differential component generating a first output signal based upon the correction value; and an integral component receiving the first output signal from the differential component, and generating a second output signal based thereon for controlling the idling speed of the engine.

2. The system according to claim 1, wherein an initial value of the integral component is set to the larger of the first and second output signals.

3. The system according to claim 1, wherein the plurality of engine characteristics includes cooling water temperature and fuel temperature.

4. The system according to claim 1, wherein the plurality of engine characteristics includes a first value table for supplying the correction value to the differential component when the position of the gas pedal is such that it equates to less than a second rotational-speed threshold, or when the position of the gas pedal is such that it equates to greater than a predetermined position threshold, and the rotational speed is less than a first rotational-speed threshold.

5. The system according to claim 4, wherein the plurality of engine characteristics further includes a second value table for supplying the correction value to the differential component when the position of the gas pedal is such that it equates to greater than the predetermined position threshold and the rotational speed is greater than the first rotational-speed threshold.

6. The system according to claim 5, wherein the differential component does not influence regulation of the idling speed when the second value table supplies the correction value.

7. The system according to claim 6, wherein the plurality of engine characteristics further includes a third value table for supplying the correction value to the differential component when the predetermined position of the gas pedal is less than position threshold and the rotational speed is less than the second rotational-speed threshold, with the second rotational speed threshold being greater than the first rotational-speed threshold.

8. The system of claim 7, wherein an influence of the differential component on the regulation of the idling speed increases when the third value table supplies the correction value.

9. A control system for regulating idling speed of an internal-combustion engine of a vehicle, comprising:

a differential component receiving at least one correction value based upon a rotational speed of the engine and upon a position of a gas pedal of the vehicle, the differential component generating a first output signal based upon the correction value;

an integral component receiving the first output signal from the differential component, and generating a second output signal based thereon for controlling the idling speed of the engine; and means coupled to the integral component for setting an initial value of the integral component as a function of the first and second output signals.

10. A control system for regulating idling speed of an internal-combustion engine of a vehicle, comprising:

a differential component receiving at least one correction value based upon a rotational speed of the engine and upon a position of a gas pedal of the vehicle, the differential component generating a first output signal based upon the correction value;

an integral component receiving the first output signal from the differential component, and generating a second output signal based thereon for controlling the idling speed of the engine; and means coupled to the integral component for setting an initial value of the integral component to the larger of the first and second output signals.

11. The system according to claim 9 or 10, wherein the correction value is further based upon the cooling water temperature and the fuel temperature.

12. The system according to claim 9 or 10, further comprising a first value table selectively coupled to the differential component for supplying the correction value to the differential component when the position of the gas pedal is less than a position threshold and the rotational speed is less than a second rotational-speed threshold, or when the position of the gas pedal is greater than the position threshold and the rotational speed is less than a first rotational-speed threshold.

13. The system according to claim 12, further comprising a second value table selectively coupled to the differential component for supplying the correction value to the differential component when the position of the gas pedal is greater than the position threshold and the rotational speed is greater than the first rotational-speed threshold.

14. The system according to claim 13, wherein when the second value table supplies the correction value, the differential component does not have any influence on the regulation of the idling speed.

15. The system according to claim 13, further comprising a third value table selectively coupled to the differential component for supplying the correction value to the differential component when the position of the gas pedal is less than the position threshold and the rotational speed is less than the second rotational-speed threshold, wherein the second rotational-speed threshold is greater than the first rotational-speed threshold.

16. The system according to claim 15, wherein when the third value table supplies the correction value, an influence of the differential component on the regulation of the idling speed increases.

17. The system according to claim 9 or 10, wherein an initial value of the integral component is set to the larger of the first and second output signals when the rotational speed reaches the idling speed.

* * * * *

UNITED STATES PATENT AND TRADEMARK OFFICE

CERTIFICATE OF CORRECTION

PATENT NO. : 5,251,598
DATED : October 12, 1993
INVENTOR(S) : Weitelmann, J.

It is certified that error appears in the above-indentified patent and that said Letters Patent is hereby corrected as shown below:

Column 7, line 27, change "6" to --5--;

Column 8, line 50, change "9 or 10" to --1,9 or 10--.

Signed and Sealed this

Fifteenth Day of November, 1994

Bruce Lehman

*Attest:*

BRUCE LEHMAN

*Attesting Officer*

*Commissioner of Patents and Trademarks*